United States Patent [19]

Bahry et al.

[11] 4,158,337

[45] Jun. 19, 1979

[54] SAFE

[76] Inventors: Abraham Bahry; Moshe Dolev, both of 45, Sokolov St., Holon, Israel

[21] Appl. No.: 839,617

[22] Filed: Oct. 5, 1977

[30] Foreign Application Priority Data

Oct. 11, 1976 [IL] Israel ..... 50659

[51] Int. Cl.[2] ..... E05G 1/026

[52] U.S. Cl. ..... 109/59 R; 109/64; 292/259 R

[58] Field of Search ..... 109/58, 59, 64, 69, 109/73; 292/137, 138, 140, 156–162, 259; 70/168, 169

[56] References Cited

U.S. PATENT DOCUMENTS

| | | | |
|---|---|---|---|
| 1,387,332 | 8/1921 | Stuart | 292/159 |
| 1,854,839 | 4/1932 | Hermann | 109/59 |
| 2,347,705 | 5/1944 | Mosler et al. | 109/59 |
| 3,481,288 | 12/1969 | Teleky | 109/58 |
| 3,715,998 | 2/1973 | Teleky | 109/58 |

FOREIGN PATENT DOCUMENTS

| | | | |
|---|---|---|---|
| 306893 | 4/1933 | Italy | 292/162 |

*Primary Examiner*—Mervin Stein
*Assistant Examiner*—David H. Corbin
*Attorney, Agent, or Firm*—Alter and Weiss

[57] ABSTRACT

A safe comprising a box-like receptacle having a substantially rectangular cut-out opening in one of its walls adapted to be closed by a flat plate-like door. Said door comprising a substantially rectangular outer wall to which is attached a rectangular panel movable relative thereto. One dimension of the panel being longer than that of the outer wall and the opening. A lock on the door is used to slide the panel between a locked and unlocked position. In the unlocked position the panel extends beyond only one side of the outer wall of the door. In the locked position the panel extends beyond the opposite sides of the outer wall of the door. The opening in the receptacle is provided with means for holding the flat plate-like door flush with the outer surface of the box-like receptacle.

5 Claims, 3 Drawing Figures

SAFE

The present invention concerns safes for storing valuables or safety deposit boxes which may be used freely standing or attached to a wall or the like.

The safes which are in use today usually have hinged doors, or else they are provided with removable door panels which can be secured in place by a key operated from outside. Such a safe is particularly described in U.S. Pat. No. 3,715,998. The main drawback of this safe is the fact that it is possible to insert a tool to bend the door panel so that the door can be forced open.

Accordingly, it is the object of the present invention to overcome this drawback and to provide a safe which is burglar-proof.

The invention is a safe comprising a box-like receptacle having a substantially rectangular cut-out opening in one of its walls adapted to be closed by a flat plate-like door. A substantially rectangular panel is attached to the inside of the door and movable relative thereto. One dimension of the panel is longer than that of the door and the opening, while the other dimension is slightly less and has integral downwardly extending flanges. A lock is fixed to the door and extends through the panel. The lock is provided with an operating member which is adapted to engage an abutment member mounted on the panel. The opening in the receptacle is provided along the sides corresponding with the flanges of the panel, with grooves to receive the flanges and along the other sides with depressed abutment strips. The said grooves and said strips being so positioned that when the door with the panel is inserted into said opening, the door lies flush with the box. The panel is adapted to be moved by said operating member so that its said one dimension engages the box beneath both corresponding edges of said opening.

The operating member may be a lug or fork. In a preferred embodiment of the invention the operating member is a cam and the abutment member a bracket having a cut-out in which said cam engages.

The invention is illustrated, by way of example only, in the accompanying drawings in which.

Figure 2:
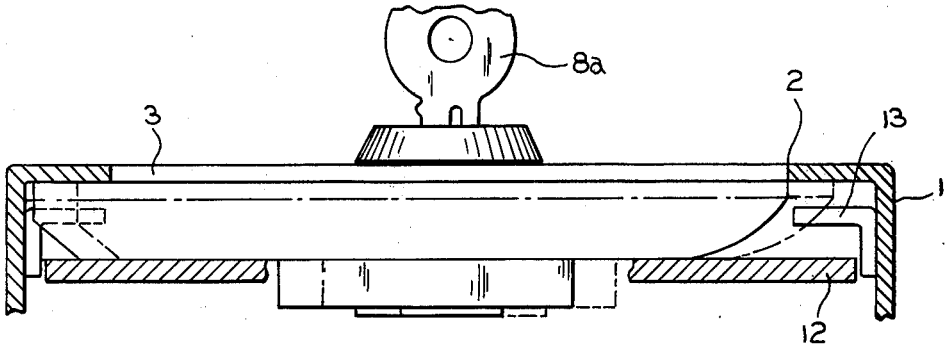
FIG. 2 is a partial section of a safe taken along the edges of the panel seen in a direction normal to that of FIG. 1.

The safe according to the invention comprises a box-like receptacle 1 having a substantially rectangular cut-out opening 2 on its top wall. A flat plate-like door 3 having dimensions substantially equal to that of opening 2 is adapted to cover the latter.

A panel 4 is movably attached to the door 3 by means of rivets 5 fixed to the door and extending through slots 6 in the panel, four rivets 5 and four slots 6 being provided to assure a linear movement of the panel relative to the door. The panel 4 is in its width slightly smaller than the door and has along its side edges integral downwardly extending flanges 7. The length of the panel is greater than the door and projects beyond it.

A lock 8 operable by a key 8*a* is mounted in the door and extends freely through a cut-out in panel 4, a cam-like operating member 9 being keyed to the end of its rotating cylinder. A bracket 10 is fixed to panel 4 having a cut-out 11 into which cam-member 9 extends, abutting against the two opposite sides of said cut-out. Below opening 2 on the sides destined to receive flanges 7, i.e., the width of the opening, an angle bar 12, integral with the walls 1 of the receptacle, is provided in which flanges 7 are housed. Below the two other sides of opening 2 angle brackets 13 are attached to the walls of receptacle 1 in such a manner that the distance between the top of the receptacle and bracket 13 is sufficient to house the projecting edge of the panel 4, the top of brackets 13 providing abutment strips for said panel.

Figure 3:
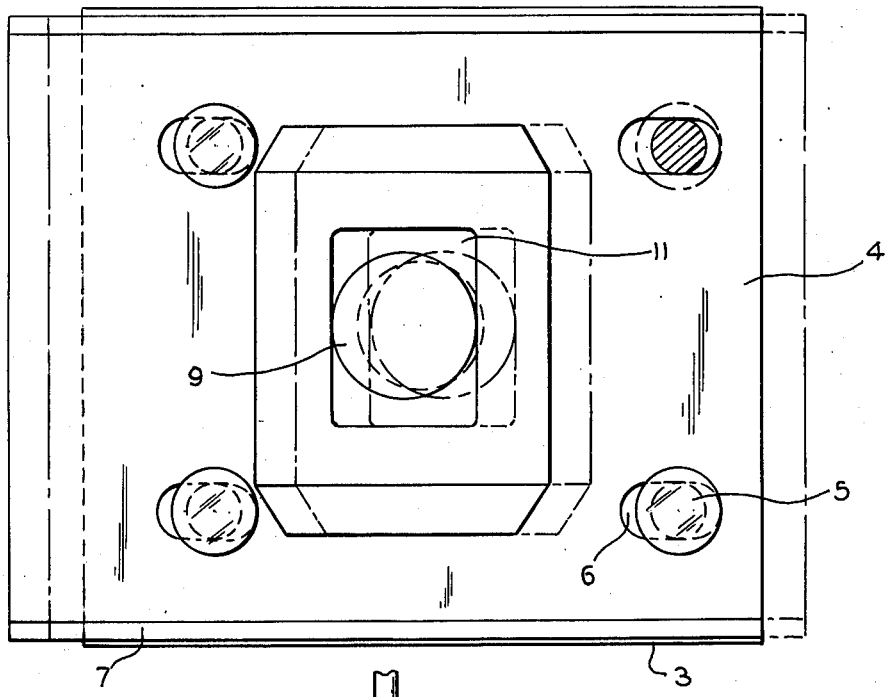
FIG. 3 is a bottom view of the door and its panel.
Figure 1:
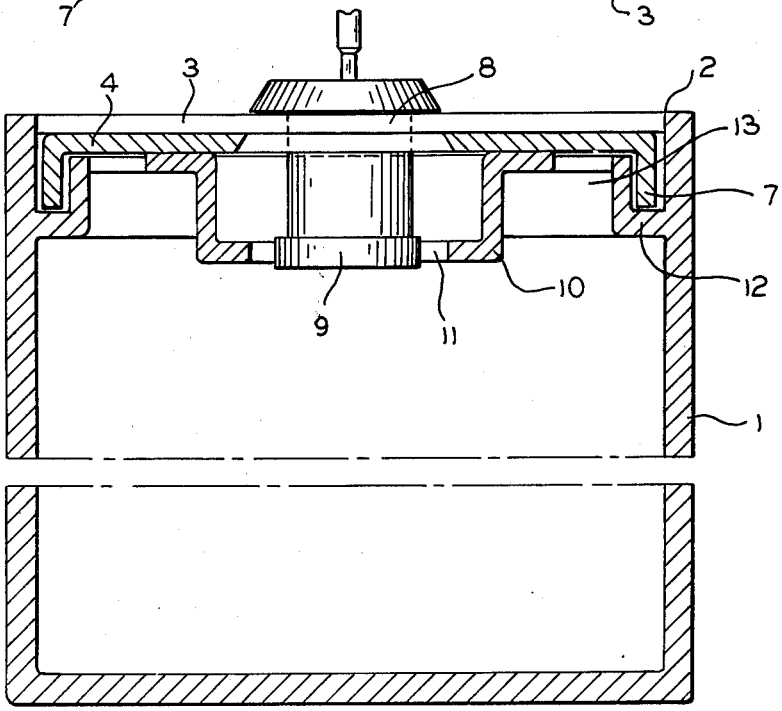
FIG. 1 is a transverse elevational section of a safe according to the invention.
Figure 4:
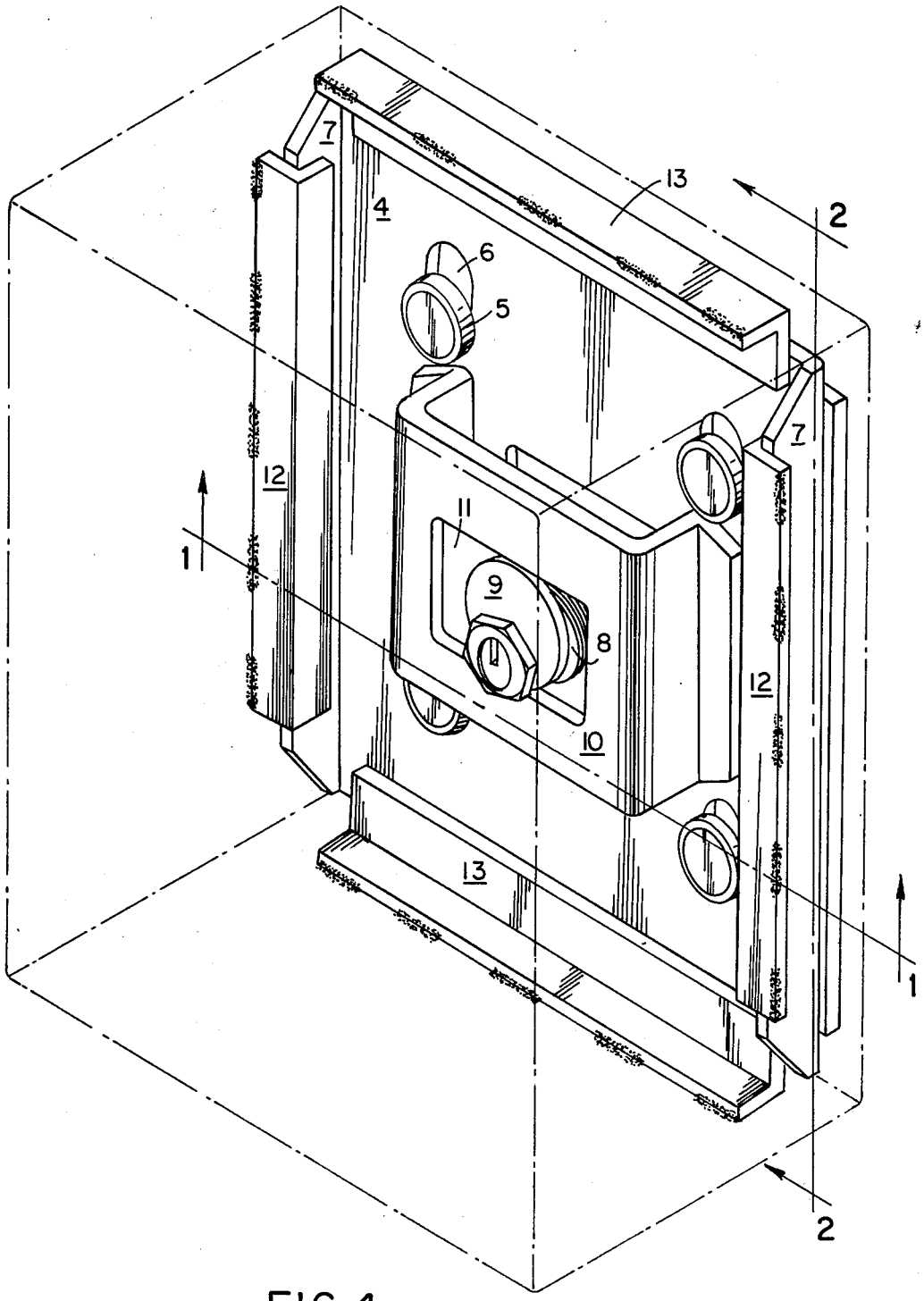
FIG. 4 is a perspective view of the inventive safe and showing by dash-dot lines 1—1 and 2—2 where the sectional views of FIG. 1 and FIG. 2 are taken.

The door with the panel is placed into the opening in such a manner that one edge of panel 4 is placed on one abutment strip 13 and flanges 7 are inserted into angle bar tracks 12, the door being simultaneously lowered to cover opening 2. A rotation of the key will cause cam 9 to rotate whereby panel 4 is forced to move linearly so that its other edge will engage between the top of the receptacle and abutment strip 13 at the opposite side. This position is shown in dotted lines in FIGS. 2 and 3. The movement of the panel is predetermined by the shape of the cam and the length of slots 6 so that in this position both flat edges of panel 4 are held in opposite sides between abutment strips 13 and the top of the receptacle.

It can be seen that in this position the door is flush with the top of the receptacle and no possibility exists of inserting any type of tool around the periphery of the door and lifting the panel from its seat in order to gain access to the interior of the receptacle, and even if the door could be bent upwards, the panel itself protects the opening.

Means other than the cam may be provided to effect the linear movement of the panel relative to the door, e.g. a rack, screw, lug, link or fork member of the like, attached to the lock and engaging a cooperating member on the panel. Furthermore, the bracket 10 need not be a separate part, but may be integral with or and swaged from panel 4.

Instead of rivet 5 and slot 6, any other means which permit linear movement may be provided for the attachment of the panel to the door. Furthermore, if desired, the parts 12 and 13 may form a one-piece frame and may be attached as such to the walls of the safe.

We claim:

1. An improved safe, said safe comprising a box-like receptacle, a cutout opening in one of the walls of the receptacle, a flat plate-like door for closing said opening, a panel movably attached to the inside of said door, the panel having substantially the same shape as said door, said panel being longer than said door along a first reference axis and being no longer than said door along a second reference axis normal to said first reference axis, abutment means in said receptacle proximate said opening for retaining said door flush with said one wall, locking means for moving said panel along said first reference axis between a first position and a second position, said first position being where said panel extends beyond said door on only one side thereof, and said second position being where said panel extends beyond said door on two opposite sides thereof and beneath the one said wall at the edges of the opening normal to said first reference axis.

2. An improved safe, said safe comprising a box-like receptacle, a cutout opening in one of the walls of the receptacle, a flat plate-like door flush with said one wall for closing said opening, a panel movably attached to the inside of said door, the panel having substantially the same shape as said door, said panel being longer than said door along a first reference axis and along a second reference axis normal to said first reference axis being no longer than said door and having downwardly extending flanges along its ends traversed by said second axis, abutment means including groove means in said receptacle proximate the two opposite sides of the opening in said receptacle traversed by said second axis for retaining said door flush with said one wall and to act as rails during the movements of said panel, locking means for moving said panel along said first reference axis between a first position and a second position, said first position being where said panel extends beyond said door on only one side thereof, and said second position being where said panel extends beyond said door on two opposite sides thereof and beneath the one said wall at the edges of its opening normal to said first reference axis.

3. The improved safe of claim 2 wherein said abutment means further includes depressed abutment strips for supporting said panel and holding said door flush with the outer wall along the two opposite sides of the opening in said receptacle traversed by said first axis.

4. The improved safe of claim 3 wherein said lock means includes cam means for moving said panel, and means on said panel abutting said cam means to cause said panel to move responsive to rotation of said cam means.

5. The improved safe of claim 4 wherein the means on the panel comprises a bracket attached thereto, and said bracket having an opening for receiving said cam means in abutting relationship whereby movement of the cam means moves the panel.

* * * * *